US007255197B2

(12) United States Patent
Horiko

(10) Patent No.: US 7,255,197 B2
(45) Date of Patent: Aug. 14, 2007

(54) MUFFLER

(75) Inventor: Yukihisa Horiko, Aichi-ken (JP)

(73) Assignee: Toyoda Boshoku Corporation, Aichi-Ken (JP)

( * ) Notice: Subject to any disclaimer, the term of this patent is extended or adjusted under 35 U.S.C. 154(b) by 236 days.

(21) Appl. No.: 10/890,063

(22) Filed: Jul. 13, 2004

(65) Prior Publication Data

US 2005/0011699 A1 Jan. 20, 2005

(30) Foreign Application Priority Data

Jul. 14, 2003 (JP) ..... 2003-196620

(51) Int. Cl.

| | |
|---|---|
| ***F01N 1/02*** | (2006.01) |
| ***F01N 1/16*** | (2006.01) |
| ***F01N 1/18*** | (2006.01) |
| ***F02M 35/00*** | (2006.01) |

(52) U.S. Cl. ..... 181/250; 181/266; 181/273; 181/276; 181/249; 181/255; 181/269; 123/184.53; 123/184.54; 123/184.55; 123/184.56; 123/184.57

(58) Field of Classification Search ..... 181/250, 181/266, 273, 276, 249, 255, 269; 123/184.53, 123/184.54, 184.55, 184.56, 184.57
See application file for complete search history.

(56) References Cited

U.S. PATENT DOCUMENTS

| | | | | |
|---|---|---|---|---|
| 3,750,839 | A * | 8/1973 | McNabney | 181/224 |
| 3,777,727 | A * | 12/1973 | Kirchner et al. | 123/587 |
| 4,237,837 | A * | 12/1980 | Toda et al. | 123/568.18 |
| 4,539,947 | A * | 9/1985 | Sawada et al. | 123/184.57 |
| 4,858,567 | A * | 8/1989 | Knapp | 123/184.56 |
| 5,283,398 | A * | 2/1994 | Kotera et al. | 181/224 |
| 5,349,141 | A * | 9/1994 | Horibe et al. | 181/224 |
| 5,771,851 | A * | 6/1998 | McLean | 123/184.57 |
| 5,930,371 | A | 7/1999 | Cheng et al. | 381/71.5 |
| 6,105,546 | A | 8/2000 | Fuesser et al. | 123/184.57 |
| 6,209,503 | B1 * | 4/2001 | Komada et al. | 123/184.56 |
| 6,332,442 | B1 * | 12/2001 | Komada et al. | 123/184.55 |
| 6,422,192 | B1 * | 7/2002 | Bloomer | 123/184.57 |
| 6,494,290 | B1 * | 12/2002 | Jessberger | 181/250 |
| 6,508,331 | B1 | 1/2003 | Stuart | 181/250 |
| 2006/0236971 | A1 * | 10/2006 | Kanda et al. | 123/184.55 |

FOREIGN PATENT DOCUMENTS

| | | | |
|---|---|---|---|
| DE | 42 28 356 | 3/1994 | |
| EP | 0 894 970 | 2/1999 | |
| GB | 2 271 494 | 4/1994 | |
| JP | 05240120 A * | 9/1993 | |
| JP | 6-58151 | 8/1994 | 35/12 |

OTHER PUBLICATIONS

European Search Report dated Nov. 16, 2004, Appl. No. EP 04 016369.

* cited by examiner

*Primary Examiner*—Lincoln Donovan
*Assistant Examiner*—Jeremy Luks
(74) *Attorney, Agent, or Firm*—McCracken & Frank LLP

(57) ABSTRACT

A muffler which reduces noises of a wide frequency band with a simple structure. Sound waves of an intake duct enter into and are received in a resonance box via a branch pipe. At the branch pipe, a movable body slidingly abuts a peripheral portion of an opening of a cut-out portion. Due to the movable body rotating, a range of opening/closing of the cut-out portion is changed, and a length of a neck portion formed by the branch pipe and an arc-shaped plate, and a lateral cross-sectional surface area of a distal end of the neck portion, are changed.

15 Claims, 16 Drawing Sheets

MUFFLER

CROSS-REFERENCE TO RELATED APPLICATION

This application claims priority under 35USC 119 from Japanese Patent Application No. 2003-196620, the disclosure of which is incorporated by reference herein.

BACKGROUND OF THE INVENTION

1. Field of the Invention

The present invention relates to a muffler which reduces noise on an intake path or an exhaust path.

2. Description of the Related Art

Mufflers, which reduce noise by changing the resonance frequency in order to be able to reduce noises over a wide range of frequencies, are known.

For example, Japanese Utility Model Application Laid-Open (JP-U) No. 6-58151 discloses a muffler in which a movable wall, which is freely rotatable, is accommodated within a resonance box having a substantially cylindrical peripheral wall. Due to a partitioning plate of the movable wall slidably abutting the inner peripheral surface of the peripheral wall of the resonance box and rotating the movable wall, the length and the like of a neck portion, which is sectioned off and formed by the peripheral wall of the resonance box and the movable wall, is changed.

In such a muffler, the arc-shaped configuration of the inner peripheral surface of the peripheral wall of the resonance box, which configuration corresponds to the length from the center of rotation of the movable wall to the end portion of the partitioning plate, must be formed highly accurately.

Further, this structure presupposes that the end plate (side surface) of the movable wall also contacts the inner surface of the resonance box slidably and airtightly. Therefore, a highly accurate planar surface must be formed over a wide range in correspondence with the inner surface of the resonance box.

SUMMARY OF THE INVENTION

In view of the aforementioned, an object of the present invention is to provide a muffler which, with a simple structure, can reduce noises over a wide frequency band.

In order to achieve the above-described object, in accordance with one aspect of the present invention, there is provided a muffler attached to a path for intake and/or exhaust, comprising: a resonance box; a branch pipe shaped as a tube, and having a connecting portion at one side in a direction of a tube axis and a communicating portion at another side in the direction of the tube axis, and connecting the resonance box to the path, a free end of the connecting portion opening into the path, and an opening of a free end of the communicating portion being shaped as one of a curved surface and an inclined surface and opening into the resonance box; and a movable body able to gradually open and close the opening of the communicating portion.

Other objects, features and advantages of the present invention will be apparent to those skilled in the art from the explanation of the preferred embodiments of the present invention illustrated in the appended drawings, and from the appended claims.

BRIEF DESCRIPTION OF THE DRAWINGS

FIG. 8A is a sectional view showing a driving section of an arc-shaped plate, and FIG. 8B is a sectional view taken along line 8B-8B of FIG. 8A and showing a state in which the arc-shaped plate is inserted into guide-shaped groove portions.

FIG. 11A is a sectional view showing a state in which a distal end portion of an arc-shaped plate has reached a distal end position of a communicating portion, and FIG. 11B is a sectional perspective view showing auxiliary chambers.

FIG. 15A is a sectional view taken along line 15A-15A of FIG. 15B, and FIG. 15B is a sectional view taken along line 15B-15B of FIG. 15A.

DETAILED DESCRIPTION OF THE INVENTION

Figure 1:
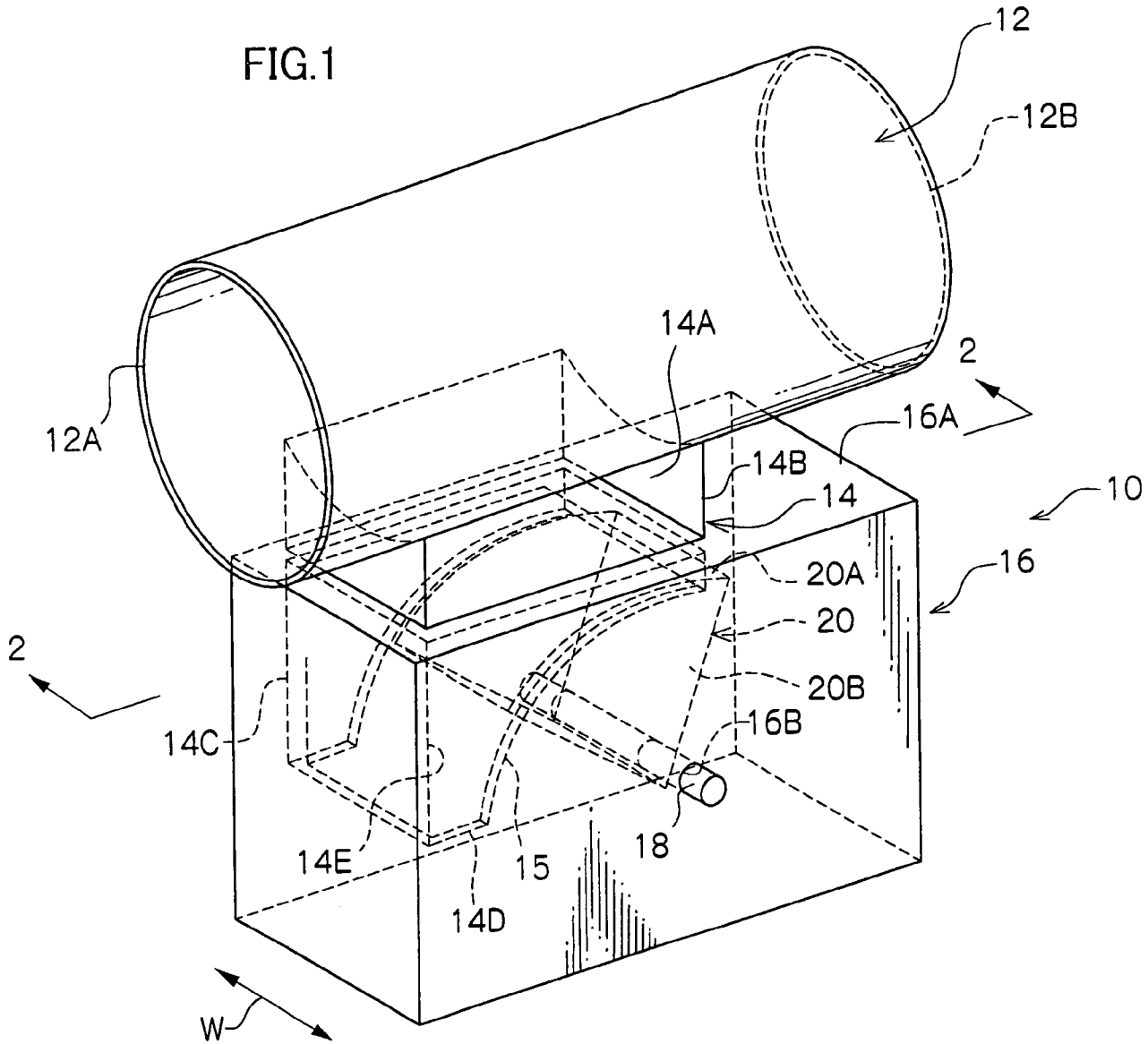
FIG. 1 is a perspective view of a muffler relating to a first embodiment of the present invention.

Plural embodiments will be described hereinafter, and parts and portions thereof which are common thereto (or which can be used in common) are denoted by the same reference numerals, and repeat description will be appropriately omitted.

Hereinafter, a muffler relating to a first embodiment of the present invention will be described in detail with reference to FIGS. 1 through 4.

As shown in FIG. 1, a muffler 10 is mounted to an intake duct 12 for an engine. However, the muffler 10 can be mounted to any arbitrary position from an air inlet of the unillustrated engine to an intake manifold.

The intake duct 12 is a tube whose cross-section is substantially circular. One end side 12A thereof is connected to the engine, whereas another end side 12B thereof is connected to an air cleaner. A branch pipe 14 has a substantially rectangular columnar configuration in which four side walls 114, 214, 314, 414 are connected together at right angles.

Figure 2:
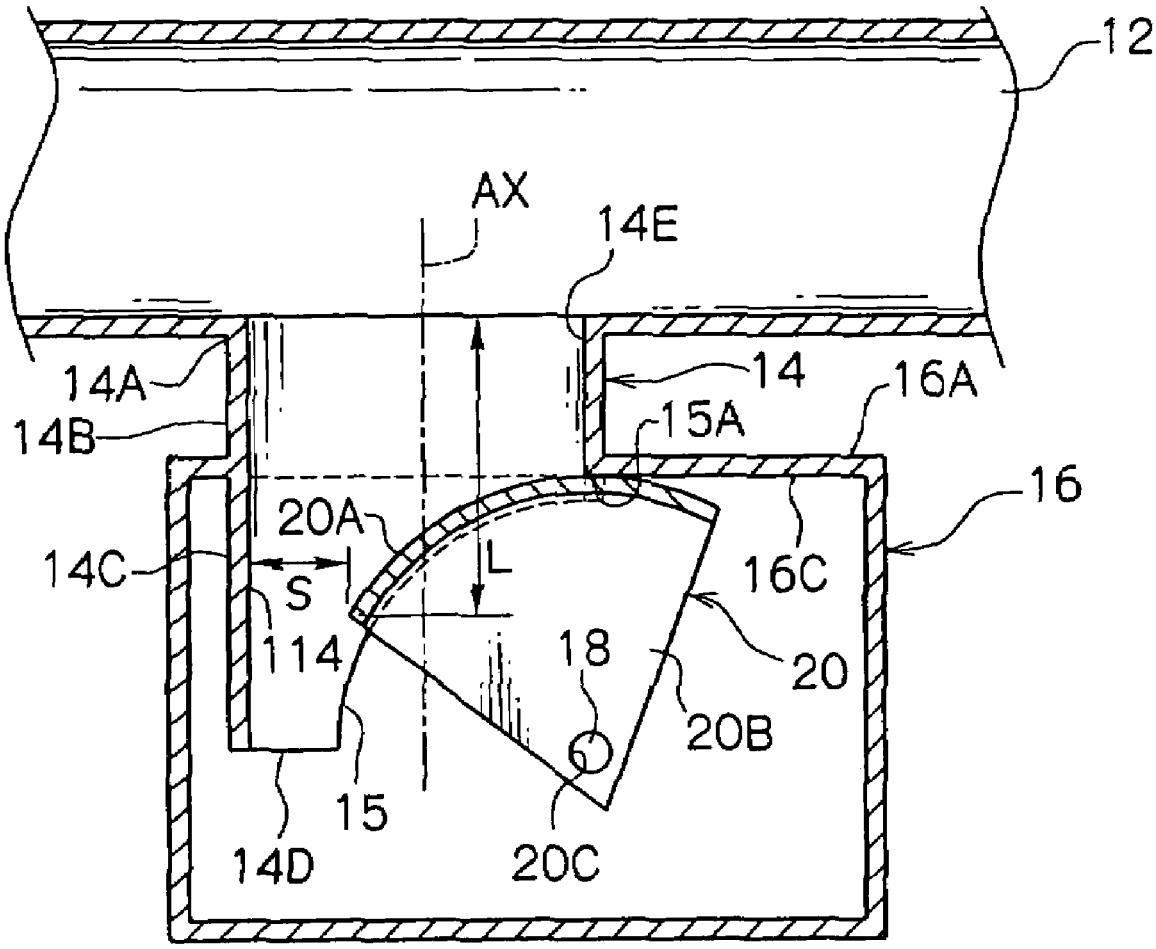
FIG. 2 is a sectional view taken along line 2-2 of FIG. 1.

A proximal end portion 14A, which is one side of the branch pipe 14, is connected to the intermediate portion of the intake duct 12, such that the axial center of the branch pipe (tube axis AX) is vertical (see FIG. 2). A resonance box 16 structuring a resonance chamber is connected to the other side of the branch pipe 14. In this way, a connecting portion 14B is formed between the intake duct 12 and the resonance box 16.

A communicating portion 14C at the lower side of the branch pipe 14 is set in the resonance box 16, and a distal end 14D opens within the resonance box 16. The communicating portion 14C has an arc-shaped cut-out portion 15 which is formed from the intermediate portion in the direction (the vertical direction) along the tube axis AX (see FIG. 2) of the right-side side wall 314 in FIG. 4, to the distal ends of the side walls 214, 414. The branch pipe 14 communicates with the interior of the resonance box via the distal end 14D and the cut-out portion 15.

An introduction cut-out 15A which is substantially rectangular is formed in the central portion in the transverse direction (the direction of arrow W) of the branch pipe 14, at the lower end of the side wall 314 of the cut-out portion 15. The bottom surface (peak surface) of the introduction cut-out 15A of the bottom end portion (the distal end portion) of the side wall 314 is in the same plane as a bottom surface 16C of a top plate 16A of the resonance box 16 (see FIG. 2). A widthwise dimension WA of the introduction cut-out 15A is equal to a widthwise dimension WB of the opposing portion of an inner surface portion 14E of the branch pipe 14 (see FIG. 4).

The resonance box 16 has a substantially parallelepiped exterior of a size which surrounds the communicating portion 14C with an interval between the resonance box 16 and the outer periphery of the communicating portion 14C. The resonance box 16 has a rotating shaft 18 which extends parallel to the top plate 16A of the resonance box 16, in a direction orthogonal to the longitudinal direction of the intake duct 12 (i.e., in the direction of arrow W).

The rotating shaft 18 is supported so as to be rotatable with respect to the resonance box 16. One end of the rotating shaft 18 extends out from a through hole 16B formed in the resonance box 16, and is connected to a driving device formed by gears, a motor, and the like, such that the rotating shaft 18 can be driven and rotated.

A movable body 20 is provided at the interior of the resonance box 16. The movable body 20 is basically structured from a pair of fan-shaped plates 20B which are parallel to one another, and an arc-shaped plate 20A which connects the arc-shaped outer peripheral portions of these fan-shaped plates 20B. The fan-shaped plates 20B have a fan-shape whose central angle is 70° to 80°. It is preferable that the arc-shaped plate 20A and the fan-shaped plates 20B of the movable body 20 be molded integrally.

Figure 4:
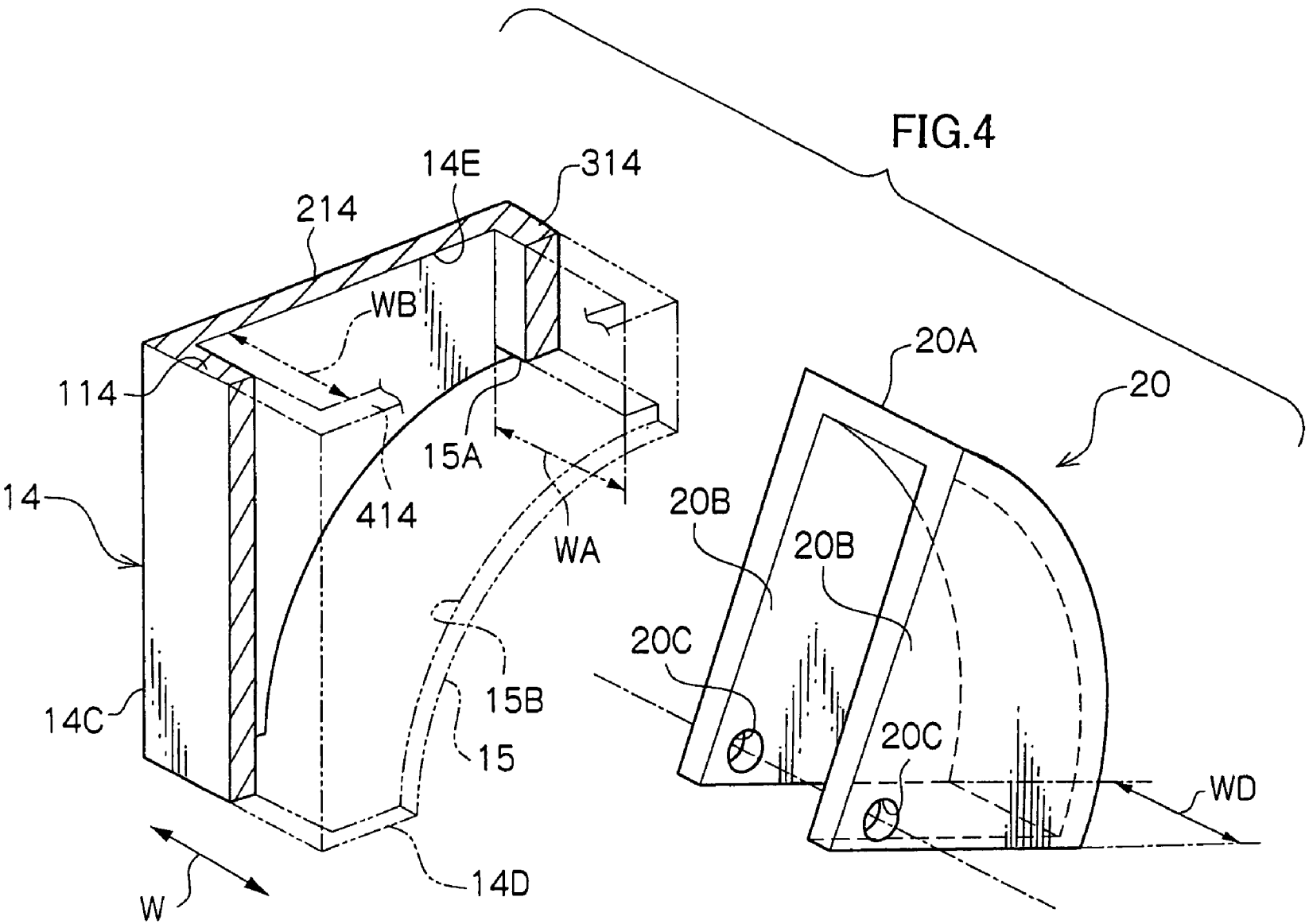
FIG. 4 is an enlarged perspective view showing a branch pipe and the movable body relating to the first embodiment, where the branch pipe is shown with the upper portion thereof cut and in half-section, and the illustration of the relationship of the connection with a resonance chamber is omitted.

As can be understood well from FIG. 4, through-holes 20C are formed at opposing positions of the both fan-shaped plates 20B. The rotating shaft 18 is inserted through and fixed in these through-holes 20C. Accordingly, the rotating shaft 18 and the movable body 20 can rotate integrally.

The outer peripheral wall of the arc-shaped plate 20A is an arc-shaped surface whose center is the axial center of the rotating shaft 18. The center of the arc of the cut-out portion 15 substantially coincides with the axial center of the rotating shaft 18. Accordingly, when the rotating shaft 18 rotates, the outer peripheral surface of the arc-shaped plate 20A can slide along and contact the bottom surface of the introduction cut-out 15A (see FIG. 2).

Note that a sealing material for sealing the sliding portions of the cut-out portion 15 and the movable body 20 can be provided. Any of various methods of fixing such as press-fitting, adhesion, a key and key groove structure, and the like, can be used in order to fix the rotating shaft 18 to the movable body 20.

The distal end arc-shaped portions of the fan-shaped plates 20B of the movable body 20 contact the opposing walls of the branch pipe side walls 214, 414 (see FIG. 4). When the movable body 20 rotates, the surface of the arc-shaped plate 20A and the fan-shaped plates 20B slide along the floor surface and the inner side surfaces of the introduction cut-out 15A (see FIG. 4), and the fan-shaped plates 20B slide along the opposing surfaces of the side walls 214, 414 at the peripheral portion of a cut-out portion opening portion 15B (see FIG. 4). A sealing material can be provided at these sliding portions.

Figure 3:
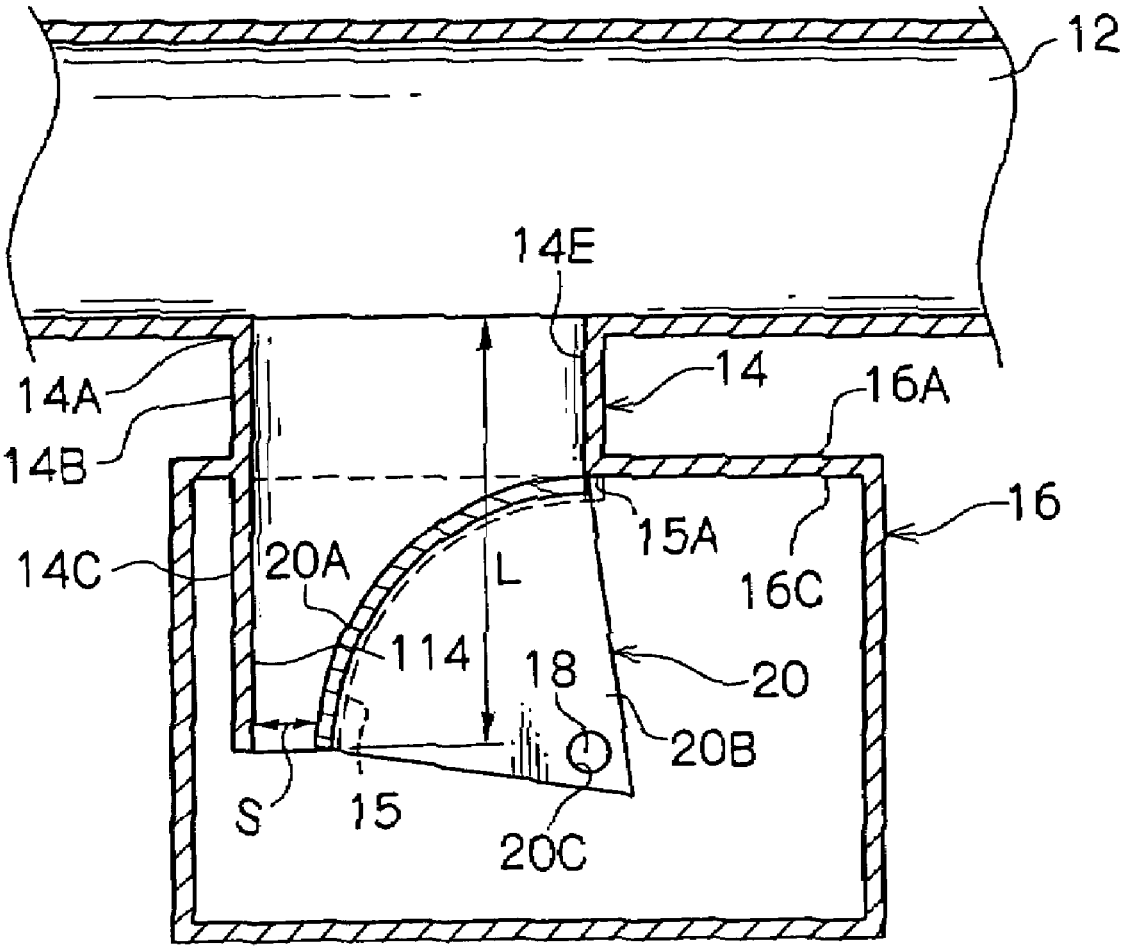
FIG. 3 is a sectional view showing a state in which a movable body has been rotated from the state of FIG. 2.

As shown in FIG. 3, as the arc-shaped plate 20A gradually closes the cut-out portion 15, a length L of a neck portion which connects the intake duct 12 and the resonance box 16 (i.e., a portion generally called the communicating pipe of the resonator) becomes longer, and a cross-sectional surface area S of the opening of the distal end portion (the lower end portion) of the neck portion becomes smaller. Accordingly, the resonance frequency can be varied in accordance with the position of the movable body 20. The neck portion is structured by the inner walls of the connecting portion 14B and the communicating portion 14C, and the outer periphery of the arc-shaped plate 20A.

Note that the rotating shaft 18 and the fan-shaped plates 20B can be molded integrally. Further, the fan-shaped plates 20B can be made to be lighter-weight by forming one or more through holes therein within a range in which the strength thereof during usage can be ensured.

Operation of the first embodiment will be described hereinafter.

Sound waves of the intake duct 12 enter into and are received in the resonance box 16 via the branch pipe 14. At the branch pipe 14, the movable body 20 is disposed slidably at the peripheral portion of the opening of the cut-out portion 15. Due to the rotation of the movable body 20, the range of opening/closing of the cut-out portion 15 is changed. The lengthwise direction dimension (i.e., the length) L of the neck portion formed by the branch pipe 14 and the arc-shaped plate 20A, and the lateral cross-sectional surface area S of the distal end of the neck portion can be changed continuously (not in a stepwise manner).

FIG. 3 illustrates a state in which the movable body 20 has been rotated further in the counterclockwise direction from the state shown in FIG. 2, and closes the entire cut-out portion 15. The final end portion (the clockwise direction end portion) of the arc-shaped plate 20A abuts the introduction cut-out 15A, and the lengthwise direction dimension L of the neck portion formed by the branch pipe 14 and the arc-shaped plate 20A is at its longest. Further, the amount by which the arc-shaped plate 20A engages with the side wall 114 of the communicating portion 14C is a maximum, and the lateral cross-sectional surface area S of the distal end of the neck portion is the most reduced.

In this way, in accordance with the rotation of the movable body 20 in the counterclockwise direction, the length L of the neck portion becomes longer, and the lateral cross-sectional surface area S of the distal end of the neck portion becomes smaller. On the other hand, in accordance with the rotation of the movable body 20 in the clockwise direction, the length L of the neck portion becomes shorter, and the lateral cross-sectional surface area S of the distal end of the neck portion increases.

Here, the noise frequency of the intake noise or the like is detected, and, in order to become a predetermined resonance frequency which corresponds to the detected frequency, control is carried out such that an operation signal is transmitted to an unillustrated driving means such as a motor or the like, and the movable body 20 within the resonance box 16 rotates to the needed rotational angle position.

In this way, noises of a frequency band of a wide width can be reduced simply and extremely effectively.

The resonance box 16 and the movable body 20 can be structured by relatively small, inexpensive parts. Further, common usage of parts is easy.

Figure 5:
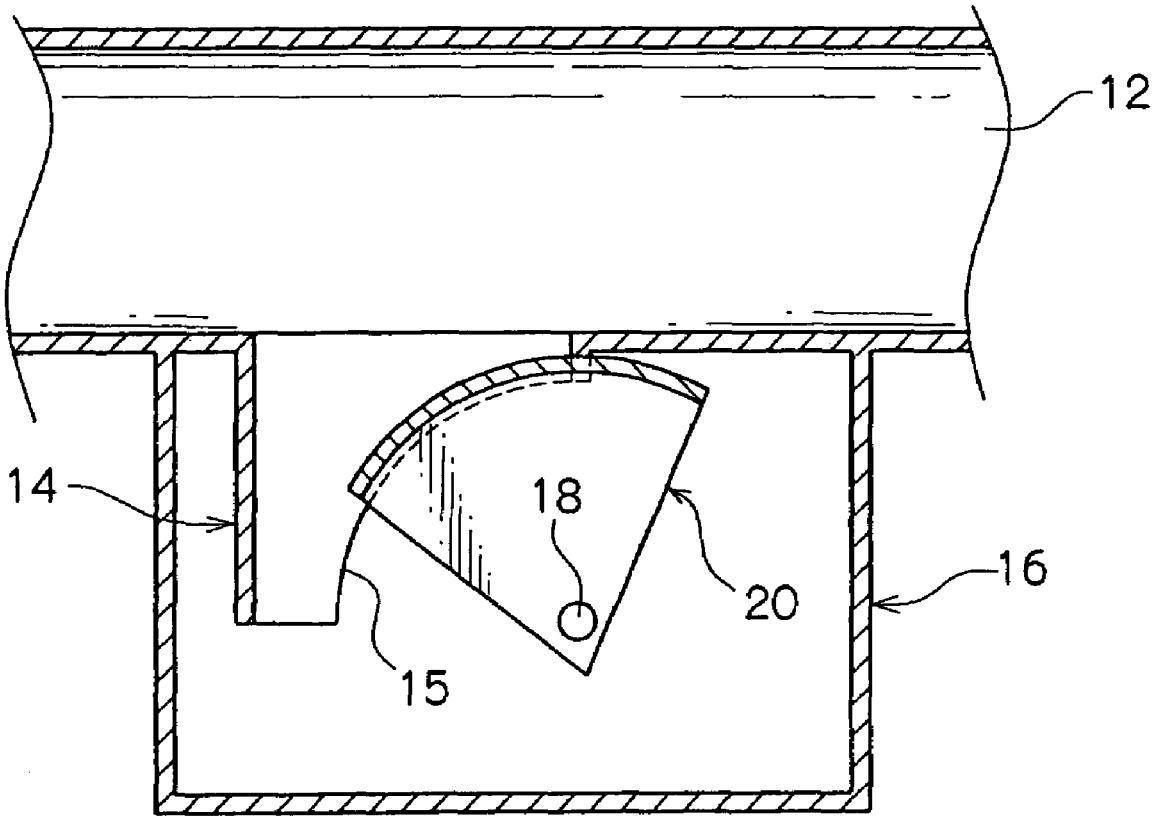
FIG. 5 is a sectional view of a muffler relating to a second embodiment of the present invention.

FIG. 5 illustrates a muffler relating to a second embodiment of the present invention.

The second embodiment differs from the first embodiment in which the annular connecting portion 14B is formed between the intake duct 12 and the resonance box 16. In the second embodiment, such an annular connecting portion does not exist, and the intake duct 12 is directly connected to the resonance box 16.

Figure 6:
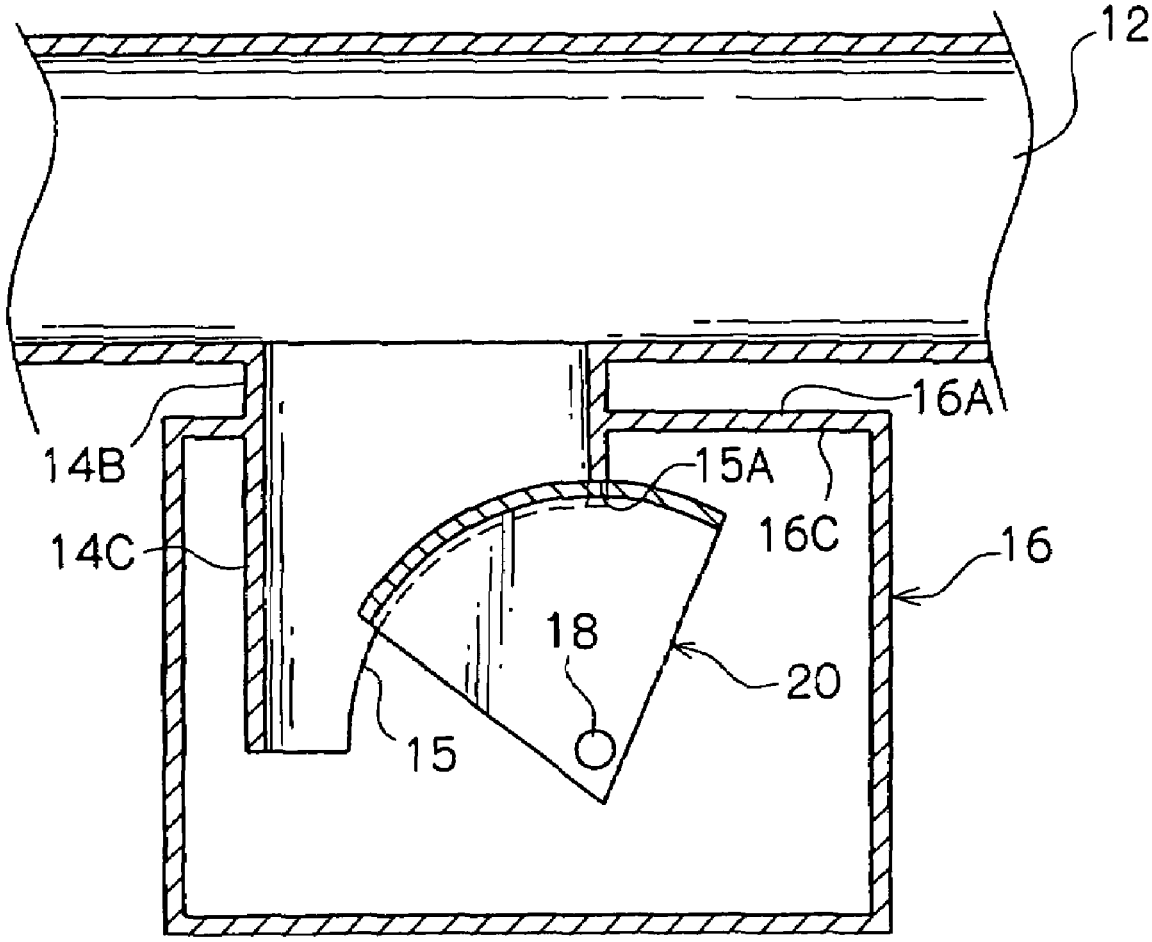
FIG. 6 is a sectional view of a muffler relating to a third embodiment of the present invention, which is equipped with a connecting portion.

FIG. 6 illustrates a muffler relating to a third embodiment of the present invention.

In the third embodiment, the floor surface of the introduction cut-out 15A is positioned at a position which is further in the resonance box 16 than the bottom surface 16C of the top plate 16A of the resonance box 16.

Figure 7:
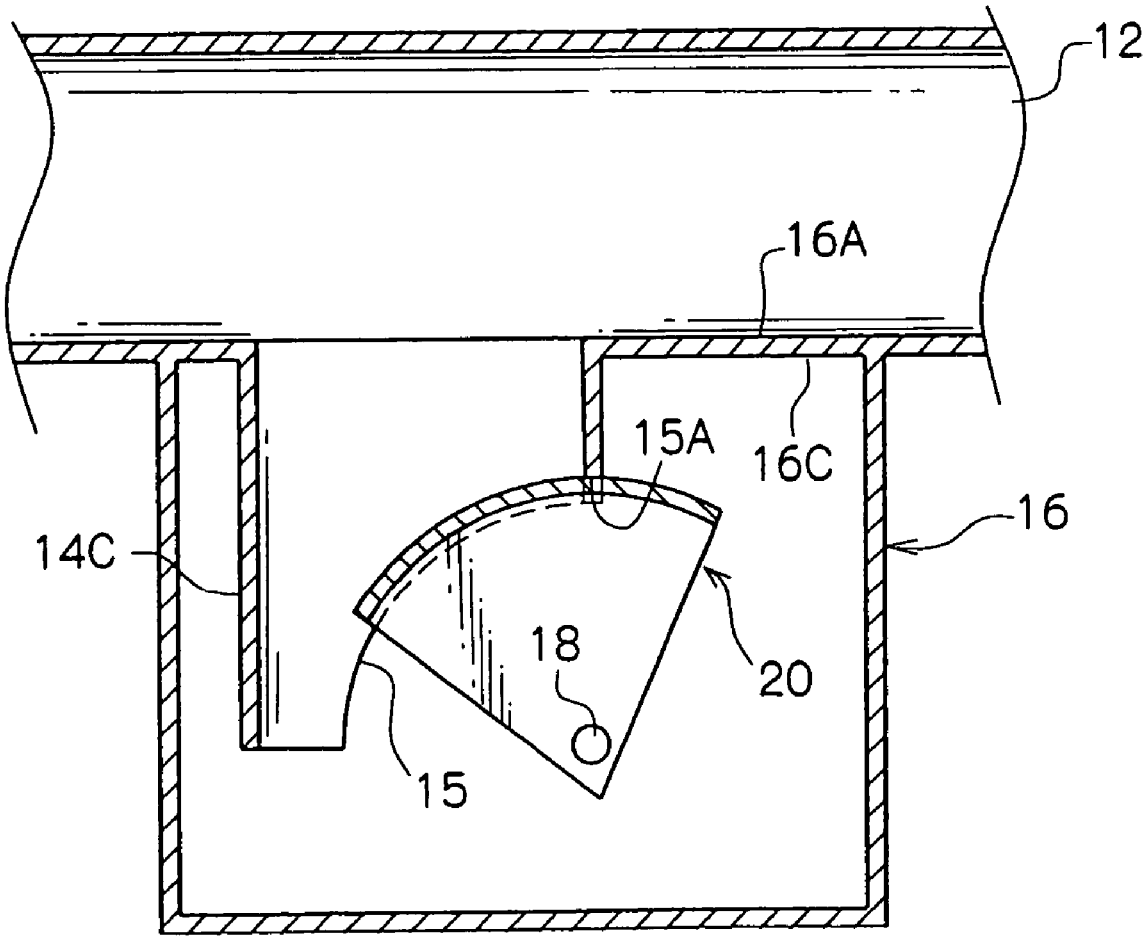
FIG. 7 is a sectional view of a variant example of the muffler, where an intake duct is directly connected to a resonance box.

FIG. 7 illustrates a modified example of the third embodiment.

In this modified example, the resonance box is directly connected to the intake duct. Namely, the portion corresponding to the connecting portion 14B in the third embodiment does not exist.

Figure 8A:
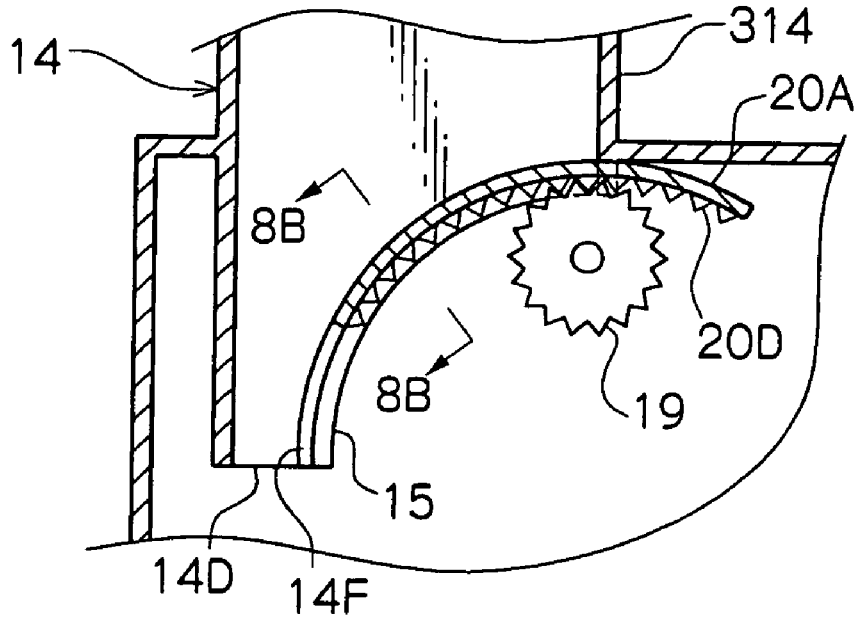
FIGS. 8A and 8B are drawings showing a muffler relating to a fourth embodiment of the present invention, where
Figure 8B:
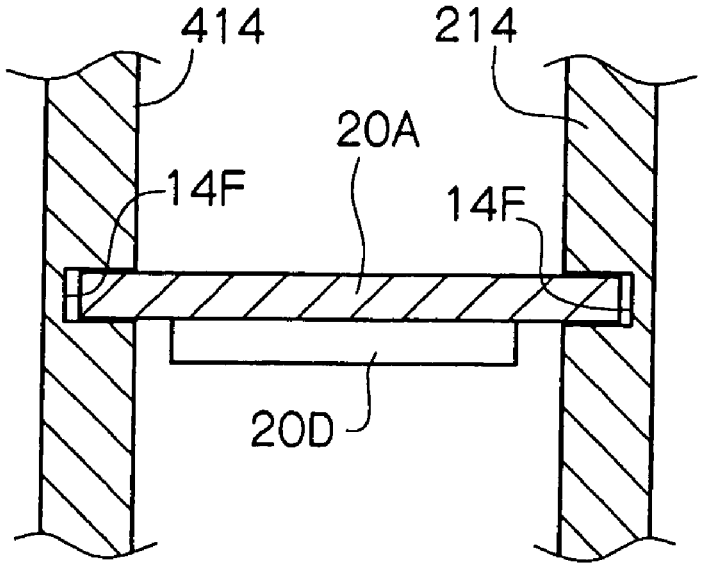

FIGS. 8A and 8B illustrate a muffler relating to a fourth embodiment of the present invention.

In the fourth embodiment, guide-shaped groove portions 14F, which are arc-shaped and oppose one another, are formed in a vicinity of the cut-out portion 15 of the branch pipe 14. The arc-shaped plate 20A is guided by the groove portions 14F, and can move along the peripheral portion of the opening of the cut-out portion 15. In order to drive the arc-shaped plate 20A, an internal-toothed gear 20D is provided at the inner side of the arc-shaped plate 20A, and a gear 19, which is connected to an unillustrated motor or the like, meshes together with the internal-toothed gear 20D.

Note that the guide-shaped groove portions and the arc-shaped plate can be made to be rectilinear rather than arc-shaped, and can be structured so as to incline from the upper right to the lower left of FIG. 8A, i.e., from the intermediate portion of the side wall 314 to the distal end 14D. In the embodiments which have been described heretofore and which will be described hereinafter, this structure of a movable body which can move rectilinearly at an incline in this way can be employed.

Figure 9:
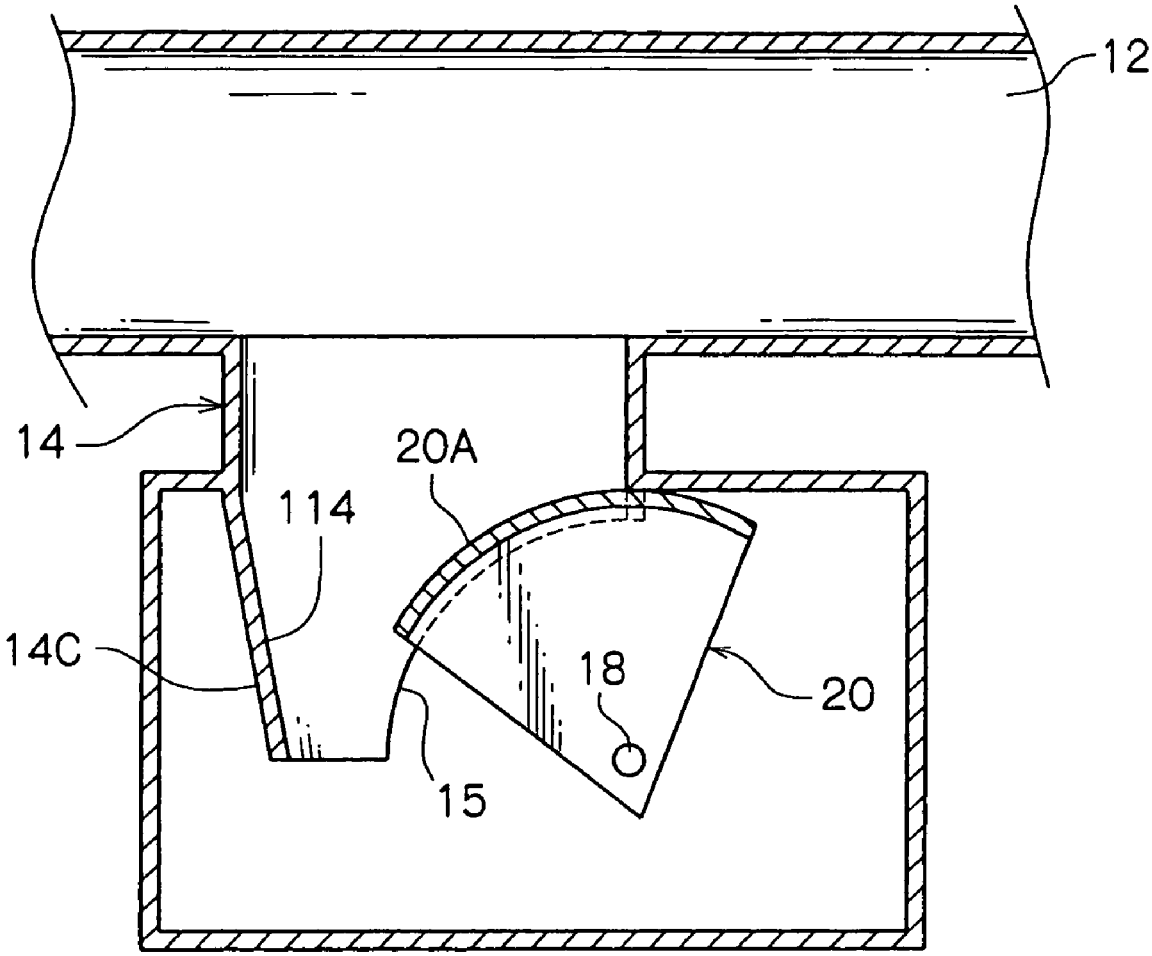
FIG. 9 is a sectional view of a muffler relating to a fifth embodiment of the present invention.

FIG. 9 illustrates a muffler relating to a fifth embodiment of the present invention.

In the fifth embodiment, the side wall 114 of the communicating portion 14C approaches the movable body 20 as the side wall 114 extends toward the distal end side thereof (the lower side in the drawing). In this structure, the lateral cross-sectional surface area of the neck portion structured from the branch pipe 14 and the arc-shaped plate 20A can be varied even more greatly by the operation (the rotation) of the arc-shaped plate 20A.

Figure 10:
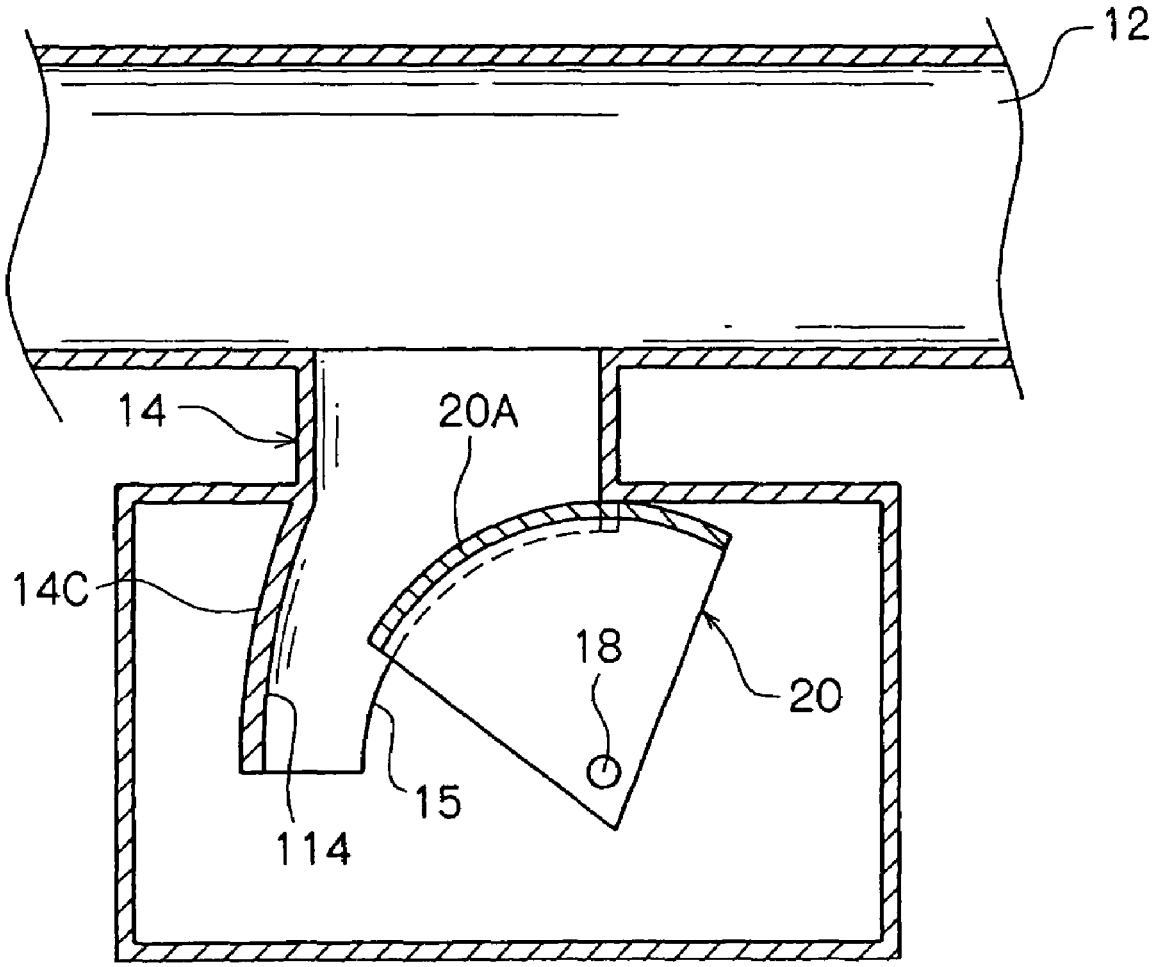
FIG. 10 is a sectional view of a muffler relating to a sixth embodiment of the present invention.

FIG. 10 illustrates a muffler relating to a sixth embodiment of the present invention.

In the sixth embodiment, the side wall 114 of the communicating portion 14C moves away from the movable body 20 as the side wall 114 extends toward the distal end side thereof (the lower side in the drawing). Accordingly, the lateral cross-sectional surface area of the neck portion can be varied gradually and continuously by the operation (the rotation) of the arc-shaped plate 20A. This is effective in cases in which different frequency characteristics are obtained by using the movable body 20 in common.

Figure 11A:
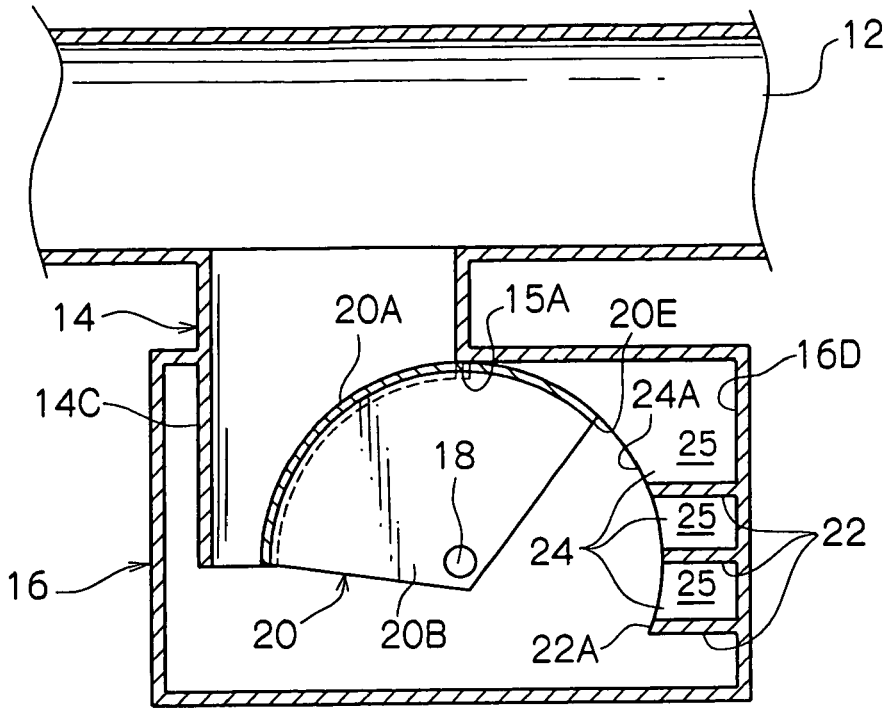
FIGS. 11A and 11B are drawings showing a muffler relating to a seventh embodiment of the present invention, where
Figure 11B:
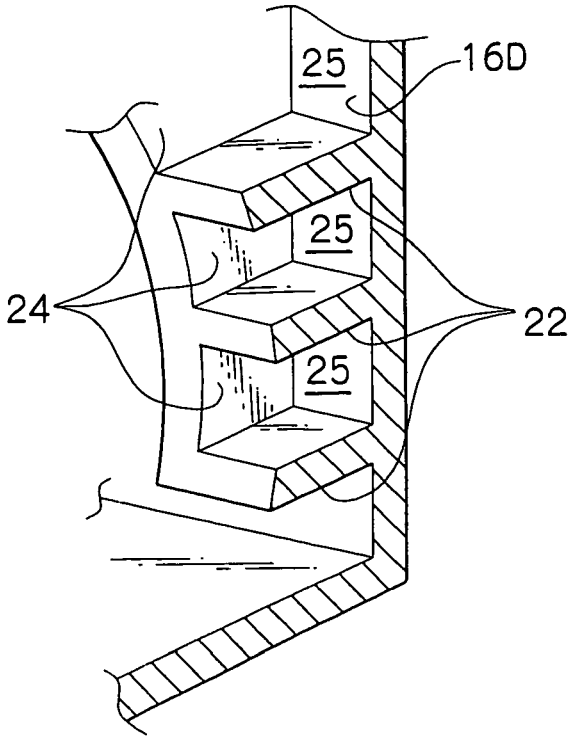
Figure 12:
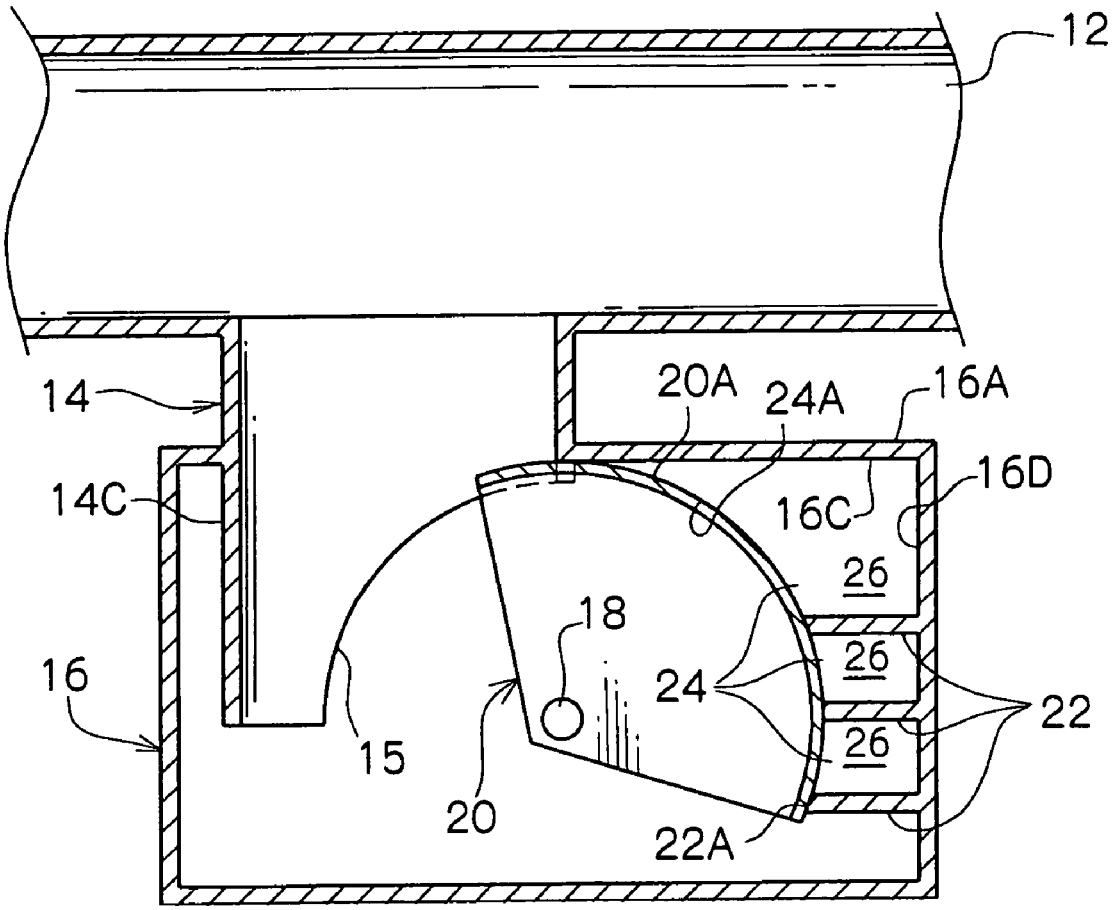
FIG. 12 is a sectional view showing a movable body rotated in a cut-out portion opening direction, in the muffler relating to the seventh embodiment.

FIGS. 11A, 11B and 12 illustrate a muffler relating to a seventh embodiment of the present invention.

In the seventh embodiment, in addition to varying the length of the neck portion and the lateral cross-sectional surface area of the distal end of the neck portion, the volume of the interior of the resonance box 16 also is varied.

FIG. 11A illustrates a state in which the distal end portion of the arc-shaped plate 20A (the left side end portion in the drawing) has reached the position of the distal end of the communicating portion 14C (the position at the lowermost end in the drawing). The portion of the arc-shaped plate 20A, at which portion the cross-section is arc-shaped, is long as compared with that in the first embodiment (see FIG. 3), and the fan-shaped plates 20B at the both sides of the arc-shaped plate 20A have fan-shapes whose central angles are obtuse angles.

Within the resonance box 16, a plurality of (three in the present embodiment) lateral ribs 22 serving as sectioning wall portions are formed at an inner wall surface 16D which extends substantially orthogonally to the axial center of the intake duct 12.

The lateral ribs 22 project substantially orthogonally from the inner wall surface 16D, and extend in a direction which is orthogonal to the surface of the drawing of FIG. 11A. The widths of the lateral ribs 22 (their lengths in the direction orthogonal to the surface of the drawing of FIG. 11A (the direction of arrow W in FIG. 1)) are the same as or shorter than the width of the arc-shaped plate 20A (the length of the arc-shaped plate 20A in the above-described direction).

As shown in FIG. 11B, the both side portions of the three lateral ribs 22 are connected by vertical ribs 24. The vertical ribs 24 project substantially orthogonally from the inner wall surface 16D.

Respective auxiliary chambers 25, which are sectioned off and formed by the lateral ribs 22 and the vertical ribs 24 for the most part, communicate with the interior of the resonance box 16 at the distal end sides of the ribs.

The projecting lengths (heights) of the lateral ribs 22 and the vertical ribs 24 are set such that the respective distal ends of the lateral ribs 22 and the vertical ribs 24 slidingly contact the arc-shaped plate 20A of the movable body 20 which is rotating.

Further, peak portions 22A of the lateral ribs 22 and peak portions 24A of the vertical ribs 24 have arc-shaped configurations which correspond to the configuration of the arc-shaped plate 20A such that the airtight quality between the arc-shaped plate 20A and the peak portions 22A, 24A can be maintained when the peak portions 22A, 24A are abutting the arc-shaped plate 20A.

FIG. 12 illustrates a state in which the movable body 20 has rotated in the direction of opening the cut-out portion 15 (the clockwise direction). When the movable body 20 rotates to this position, several (three in the drawing) airtight spaces (the auxiliary chambers 25), which are sectioned-off and formed (sealed) by the arc-shaped plate 20A, the lateral ribs 22, the vertical ribs 24, the inner wall surface 16D, the bottom surface 16C of the top plate 16A, and the like, are formed. A volume V of the interior of the resonance box 16 is thereby substantially reduced.

Because the portion of the arc-shaped plate 20A where the cross-section thereof is arc-shaped is long, it is effective in varying the volume V. Note that a structure can be formed in which the change in the volume V is made gradual by providing even more of the lateral ribs 22 and fractionalizing the spaces which can be sealed (the auxiliary chambers).

As described above, in the seventh embodiment, when the rotating body 20 rotates in the direction of opening the cut-out portion 15 (the clockwise direction), the volume V of the interior of the resonance box 16 is substantially reduced in accordance therewith. On the other hand, when the rotating body 20 rotates in the direction of closing the cut-out portion 15 (the counterclockwise direction), the volume V of the interior of the resonance box 16 is substantially increased in accordance therewith. In this way, the three factors which can change the resonance frequency, i.e., (1) the length of the neck portion, (2) the lateral cross-sectional surface area of the distal end of the neck portion, and (3) the volume of the interior of the resonance box 16, can be varied.

Note that the vertical ribs 24 can be rendered useless in a case in which a widthwise dimension WD of the arc-shaped plate 20A (see FIG. 4) and the widthwise dimension of the inner wall surface of the resonance box 16 (the length in the direction orthogonal to the surface of the drawing of FIG. 12: the length in the direction of arrow W in FIG. 1) are equal.

Figure 13:
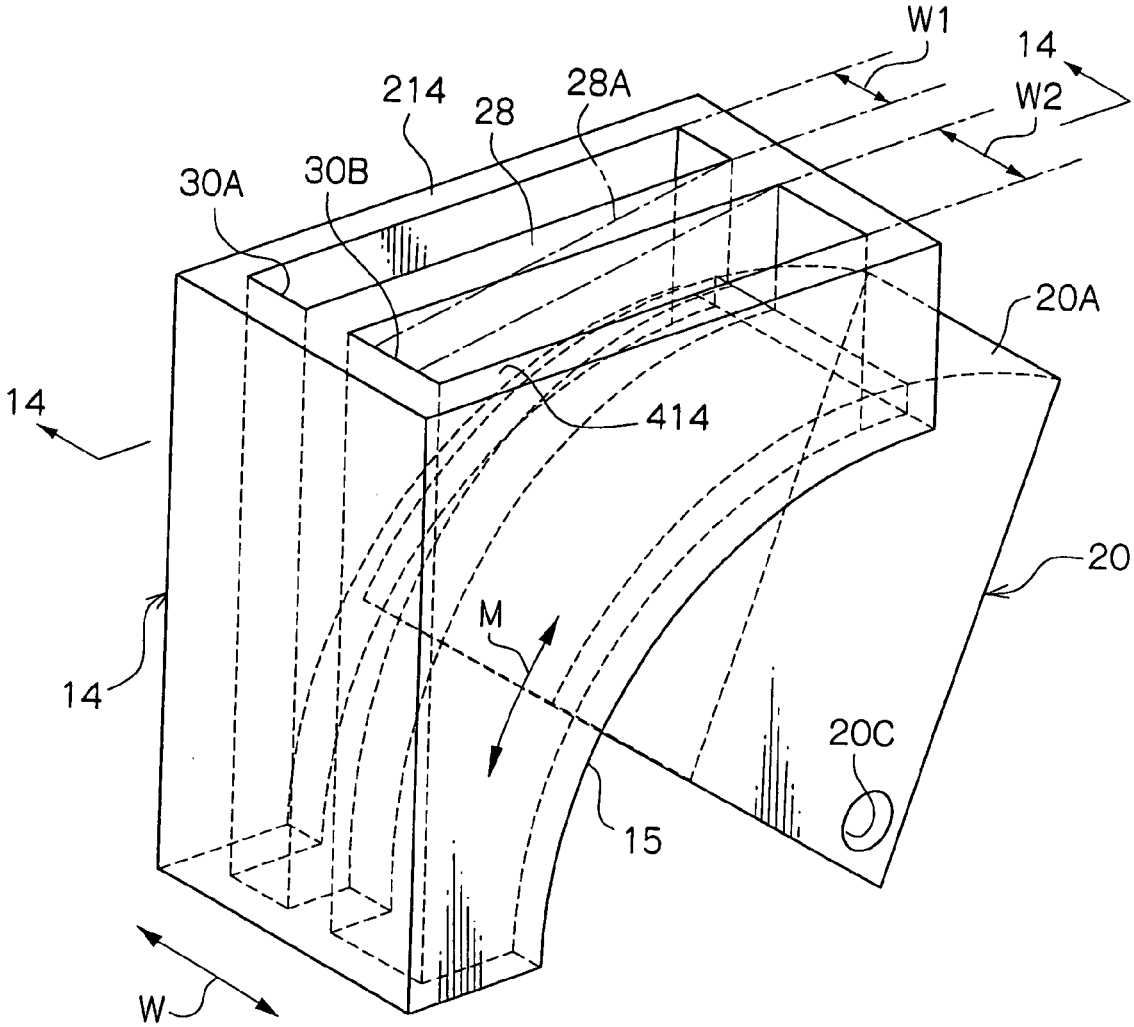
FIG. 13 is an enlarged perspective view showing a branch pipe and a movable body of a muffler relating to an eighth embodiment of the present invention.
Figure 14:
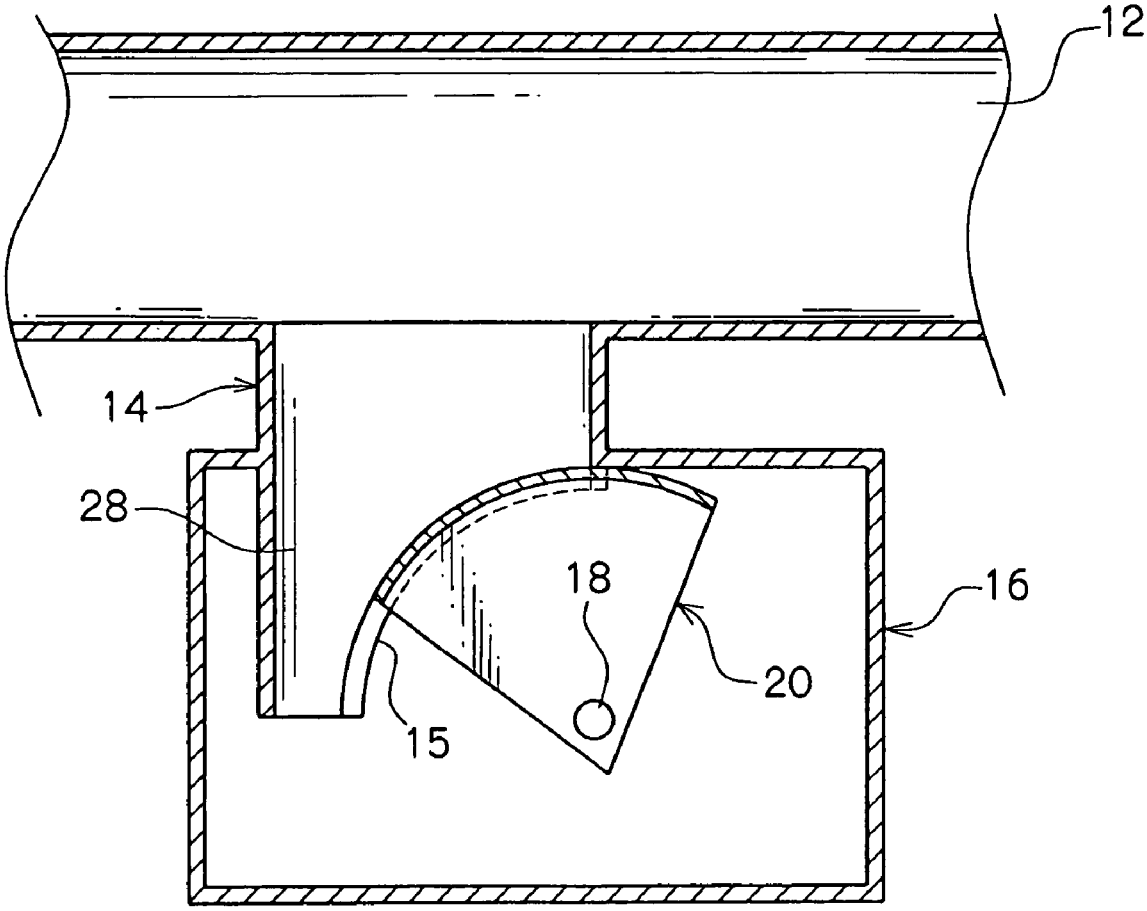
FIG. 14 is a sectional view taken along line 14-14 of FIG. 13.

FIGS. 13 and 14 illustrate a muffler relating to an eighth embodiment of the present invention.

In the eighth embodiment, a partitioning wall 28 is formed so as to follow along the moving direction of the movable body 20, between the side walls 214, 414 of the branch pipe 14 which are the two surfaces which oppose one another in the widthwise direction (the direction of arrow W). The partitioning wall 28 partitions a pass-through portion 14E of the branch pipe 14 (see FIG. 4) into two, and is disposed parallel to the side walls 214, 414.

A first through path 30A and a second through path 30B, which have been separated by the partitioning plate 28, form, together with the arc-shaped plate 20A, respectively independent neck portions. A widthwise dimension W1 of the first through path 30A and a widthwise dimension W2 of the second through path 30B are not equal (W1≠W2).

Because the cross-sectional surface areas of the neck portions are different, noises of two frequency components can simultaneously be reduced.

In the intake noise generated by the intake pulsation of the engine, the noise level of a specific frequency corresponding to the engine speed becomes large. For example, a frequency F (Hz) of the noise at a 4-cycle engine is expressed by following formula 1, where the engine speed is R (rpm) and the number of cylinders is s.

$$F=(1/2)\times R\times(1/60)\times s\times n \quad (1)$$

Here, n=1, 2, 3, . . .

The main components of the intake noise generated at, for example, 3000 rpm in a four-cylinder engine include 100 Hz (first order of engine combustion (or explosion first-degree component)), 200 Hz (second order of engine combustion (or explosion second-degree component)), 300 Hz (third order of engine combustion (or explosion third-degree component)), . . .

The present muffler functions as a resonator-type muffler. A resonator resonance frequency f (Hz) is expressed by following formula 2, where the lateral cross-sectional surface area of the neck portion (the communicating pipe) is S ($cm^2$), the length of the neck portion (the communicating pipe) is L (cm), and the volume is V (cc).

$$f=(C/2\pi)\times[\sqrt{\{S/(L\times V)\}}] \quad (2).$$

Here, C=34,000 cm/s (sound speed).

When the widthwise dimension W1 of the first through path 30A and the widthwise dimension W2 of the second through path 30B are set, if the partitioning wall 28 is structured and disposed such that, for example, W1:W2=1:4, the noises of the 1:2 frequency components can be reduced simultaneously. If the other configurations and dimensions are set appropriately, the noises of the first order and the second order of engine combustion can be reduced simultaneously. Similarly, if the partitioning wall 28 is disposed such that W1:W2=1:9, the first order and the second order of engine combustion of the noise can be reduced simultaneously.

If the side walls 214, 414 are not parallel to the partitioning wall 28, the frequency ratio can be changed in accordance with the position and the state of abutment of the movable body 20 with respect to the cut-out portion 15 of the arc-shaped plate 20A.

For example, if a partitioning wall 28A is positioned as shown by the imaginary line in FIG. 13, the widthwise dimension (W1) of the first through path 30A at the side near the movable body 20 is narrow, and gradually becomes wider the further away from the movable body 20. On the other hand, the widthwise dimension (W2) of the second through path 30B at the side near the movable body 20 is wide, and gradually becomes more narrow the further away from the movable body 20.

Accordingly, when the movable body 20 moves to close the cut-out portion (the opening portion) 15, the decrements in the lateral cross-sectional surface areas (the opening portions) are respectively different at the first through path 30A and the second through path 30B. Namely, the decreased frequency ratio of the first through path 30A and the second through path 30B can change in accordance with the angle of rotation of the movable body 20.

Note that two or more of the partitioning plates 28 can be provided. For example, if two partitioning plates 28 are provided and the ratio of the widthwise dimensions of the neck portion divided into three within the branch pipe 14 is set to be 1:4:9, the noises of the first order, the second order, and the third order of engine combustion can be reduced markedly. Namely, noises of a plurality of orders of engine combustion or noises of components of a plurality of degrees in a wide frequency band of the engine of a vehicle or the like can be reduced simultaneously.

In this way, noises of frequencies of desired ratios can be reduced simultaneously. Further, there is no need for a complex structure in order to rotate the movable body 20. Rotating of the movable body 20 can be carried out simply by, for example, one motor (driving means), which is extremely practical and economical.

In order to vary the frequency ratio, a mechanism can be added which can change the ratio of the widthwise dimensions (W1:W2) of the neck portion which is divided by the partitioning wall 28 within the branch pipe 14. Namely, for example, the partitioning wall 28 can be disposed so as to be movable in the widthwise direction (the direction of arrow W) within the branch pipe 14, and can be moved in the widthwise direction (the direction of arrow W) by a driving means such as a motor or the like in accordance with the frequency for which a reduction is desired.

Figure 15A:
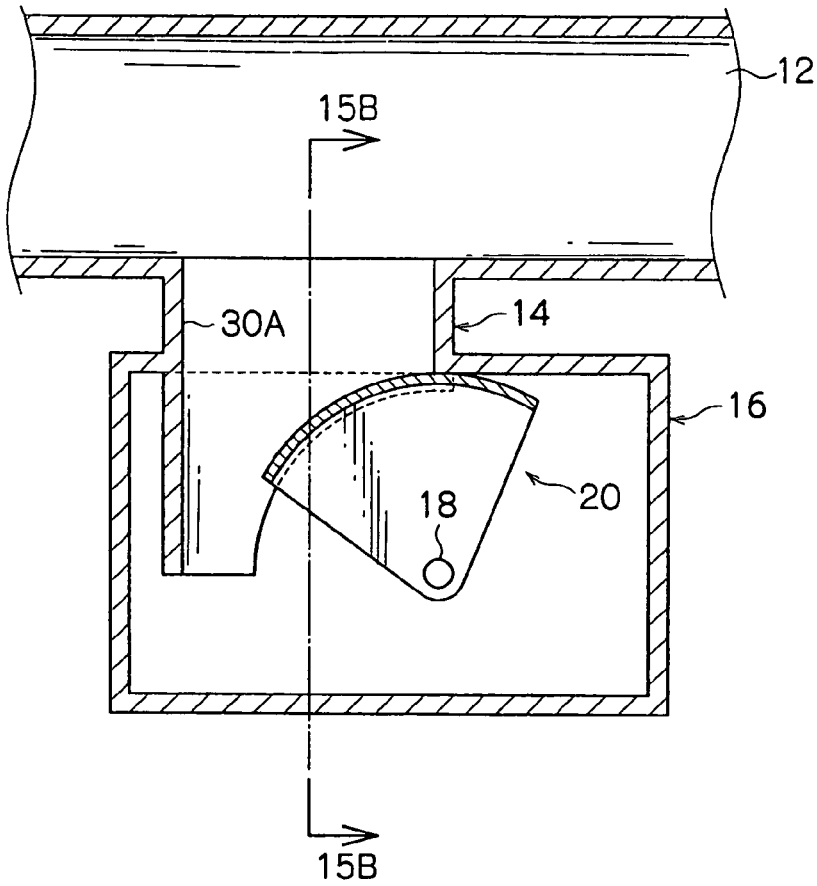
FIGS. 15A and 15B are drawings showing a muffler relating to a ninth embodiment of the present invention, where
Figure 15B:
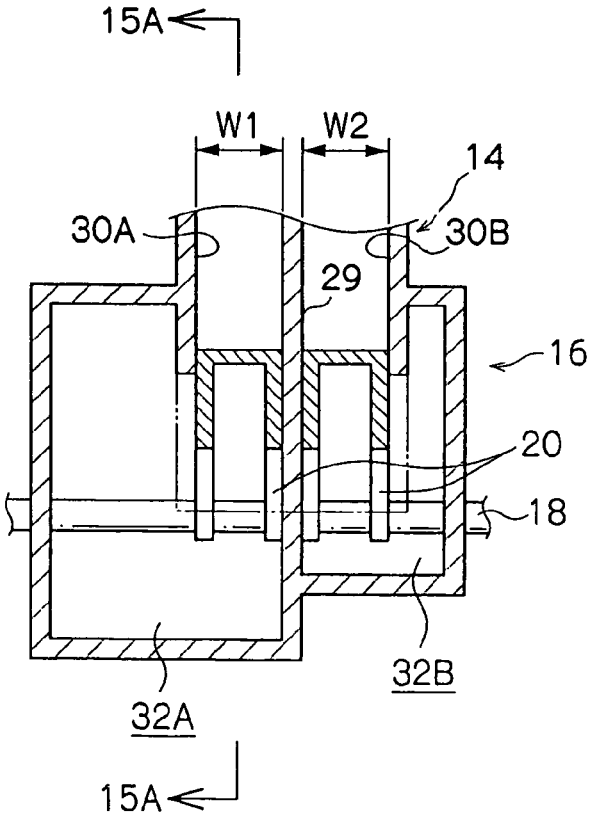

FIG. 15 illustrates a muffler relating to a ninth embodiment of the present invention.

In the ninth embodiment, the first through path 30A and the second through path 30B are connected to a respectively independent first resonance chamber 32A and second resonance chamber 32B, and noises of two frequency components can be reduced simultaneously.

The interior of the branch pipe 14 is partitioned by a partitioning wall 29. The widthwise dimension W1 of the first through path 30A and the widthwise dimension 30B of the second through path 30B are substantially the same. Accordingly, the first through path 30A and the second through path 30B have substantially the same lateral cross-sectional surface areas.

The partitioning wall 29 partitions the resonance box 16 by being set in the resonance box 16 such that the first resonance chamber 32A and the second resonance chamber 32B are formed.

Respective movable bodies 20, 20 are disposed in the first resonance chamber 32A and the second resonance chamber 32B. The resonance bodies 20, 20 are fixed to the one rotating shaft 18, and can rotate together with the rotating shaft 18. Note that a structure can be used in which the movable bodies 20, 20 are fixed to separate rotating shafts and are operated independently of one another.

A volume V1 of the first resonance chamber 32A and a volume V2 of a second resonance chamber 32B are unequal ($V1 \neq V2$). By setting the volumes V1, V2 on the basis of formula (2) of the above-described eighth embodiment, noises of two desired frequency components can be reduced simultaneously.

Two or more of the partitioning walls 29 can be provided.

Figure 16A:
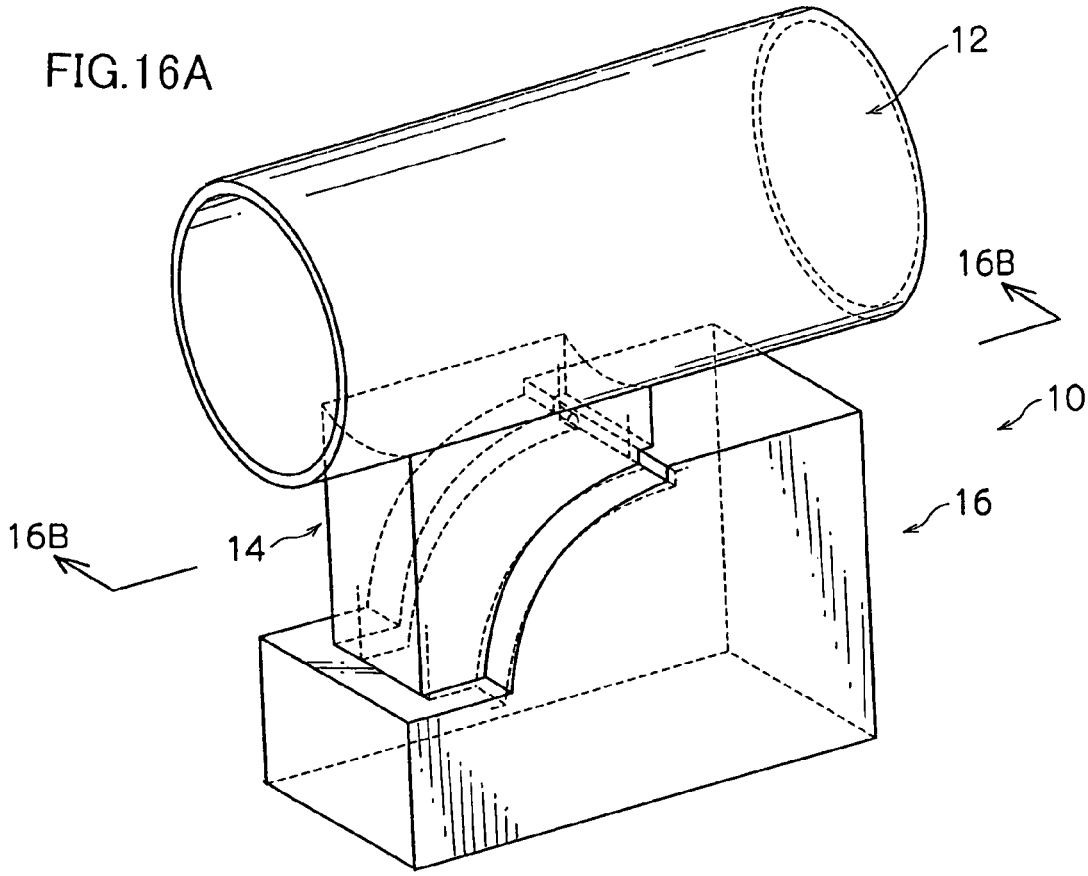
FIG. 16A is a perspective view showing a muffler relating to a tenth embodiment of the present invention in which a distal end of a branch pipe is connected to a resonance box.
Figure 16B:
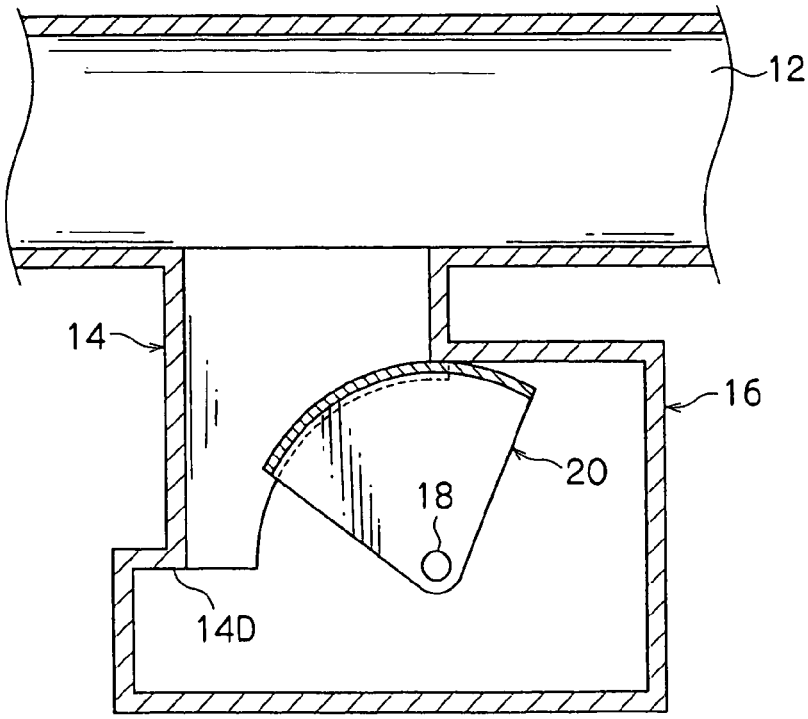
FIG. 16B is a sectional view taken along line 16B-16B of FIG. 16A.

FIGS. 16A and 16B illustrate a muffler relating to a tenth embodiment of the present invention.

In the tenth embodiment, the majority of the branch pipe is exposed at the exterior of the resonance box. Namely, the distal end of the branch pipe is joined to the resonance box without the branch pipe being set in the resonance box.

The present invention is not limited to the above-described first through tenth embodiments, and various changes and modifications can be carried out.

For example, the resonance box may have a different container-like configuration, such as may be substantially cylindrical or the like.

Further, instead of the structure in which the surface of the arc-shaped plate and the fan-shaped plates slide at the peripheral portion of the opening of the cut-out portion, a structure in which only the surface of the arc-shaped plate slides thereat can be employed.

Moreover, in place of the structure in which the movable body is moved along the cut-out portion provided at the branch pipe, a structure can be employed in which the movable body is moved at the inner side of the branch pipe, without providing the cut-out portion. Or, instead of a structure provided with the cut-out portion, a structure in which one or more through-holes are provided in side walls can be used.

In addition, instead of connecting the muffler to the intake duct 12, the muffler can be connected to, for example, an air cleaner or the like. Noise can be reduced in this way as well.

As described above, in accordance with the muffler of the present invention, noises over a wide frequency band can be effectively reduced by a simple structure.

What is claimed is:

1. A muffler attached to a path for intake and/or exhaust, comprising:

a resonance box;

a branch pipe shaped as a tube, and having a connecting portion at one side in a direction of a tube axis and a communicating portion at another side in the direction of the tube axis, and connecting the resonance box to the path, a free end of the connecting portion opening into the path, and an opening of a free end of the communicating portion being shaped as one of a curved surface and an inclined surface and opening into the resonance box; and a movable body that gradually changes an opening area of the opening and an effective length of the branch pipe from a first state to a second state wherein the opening area is greater in the second state than in the first state and the effective length is greater in the first state than in the second state.

2. The muffler of claim 1, wherein the connecting portion of the branch pipe is exposed at an exterior of the resonance box, and the communicating portion of the branch pipe is set within the resonance box.

3. The muffler of claim 1, wherein a majority of the branch pipe is set within the resonance box.

4. The muffler of claim 1, wherein the movable body includes a cylindrical surface which conforms to a configuration of the opening of the communicating portion in order to close the opening of the communicating portion, and the movable body swings around an axis of rotation which substantially includes a center of curvature of the cylindrical surface.

5. The muffler of claim 1, wherein the movable body includes an arc-shaped plate having a cylindrical surface which conforms to a configuration of the opening of the communicating portion in order to close the opening of the communicating portion, and a pair of guide grooves guiding both sides of the arc-shaped plate, and a driving mechanism for driving the arc-shaped plate.

6. The muffler of claim 1, wherein the communicating portion includes an inner surface which is inclined so as to gradually approach the tube axis, from a side opposite the free end toward the free end.

7. The muffler of claim 1, wherein the communicating portion includes an inner surface which is curved so as to gradually move away from the tube axis, from a side opposite the free end toward the free end.

8. The muffler of claim 1, wherein the resonance box includes one or more auxiliary chambers provided at an interior of the resonance box.

9. The muffler of claim 8, wherein each of the auxiliary chambers has an opening which can be opened and closed by the movable body.

10. The muffler of claim 8, wherein the auxiliary chambers are disposed along a direction of movement of the movable body.

11. The muffler of claim 1, wherein the branch pipe includes at least one partitioning wall which extends along a direction of movement of the movable body and which divides an interior of the branch pipe into a plurality of through paths.

12. The muffler of claim 11, wherein cross-sectional configurations of the through paths in a direction traversing the tube axis are the same.

13. The muffler of claim 11, wherein cross-sectional configurations of the through paths in a direction traversing the tube axis are respectively different.

14. The muffler of claim 1, wherein the muffler includes a partitioning wall which extends along a direction of movement of the movable body, and divides an interior of the branch pipe into two through paths, and divides the resonance box into two resonance chambers.

15. The muffler of claim 1, wherein a majority of the branch pipe is exposed at an exterior of the resonance box.

* * * * *